US012767283B2

(12) United States Patent
Cazer

(10) Patent No.: US 12,767,283 B2
(45) Date of Patent: Oct. 20, 2026

(54) STAND UP PADDLE BOARD SLED

(71) Applicant: Renee Mae Cazer, Castle Rock, CO (US)

(72) Inventor: Renee Mae Cazer, Castle Rock, CO (US)

( * ) Notice: Subject to any disclaimer, the term of this patent is extended or adjusted under 35 U.S.C. 154(b) by 591 days.

(21) Appl. No.: 18/134,038

(22) Filed: Apr. 13, 2023

(65) Prior Publication Data

US 2023/0331354 A1 Oct. 19, 2023

Related U.S. Application Data

(60) Provisional application No. 63/330,719, filed on Apr. 13, 2022.

(51) Int. Cl.
*B63B 32/80* (2020.01)
*B63B 32/22* (2020.01)
*B63B 32/77* (2020.01)

(52) U.S. Cl.
CPC ..... *B63B 32/80* (2020.02); *B63B 32/22* (2020.02); *B63B 32/77* (2020.02)

(58) Field of Classification Search
CPC ..... B63B 32/22; B63B 32/80; B63B 32/87; B65G 7/02; B65G 7/12; B62B 13/16
See application file for complete search history.

(56) References Cited

U.S. PATENT DOCUMENTS 2,382,830 A * 8/1945 Sunbury ..... D06F 83/00 428/921
3,884,490 A * 5/1975 Hellman ..... B62B 13/16 280/18
4,006,912 A * 2/1977 Perlich ..... A63C 5/062 280/809
4,206,933 A * 6/1980 Koch ..... B62B 13/16 280/18
4,719,952 A * 1/1988 Geronimo ..... B63B 32/70 441/74
4,878,980 A * 11/1989 Stedman ..... B63B 32/22 428/397
4,887,823 A * 12/1989 Hallett ..... B62B 13/16 224/921
5,163,550 A * 11/1992 Hawk ..... B63B 32/80 224/901.4

(Continued)

FOREIGN PATENT DOCUMENTS

FR 3034084 A1 * 9/2016 ..... A45C 13/1046
WO WO-2018197899 A1 * 11/2018 ..... A45C 5/143

*Primary Examiner* — Michael H Wang

(57) ABSTRACT

In some implementations, a stand up paddleboard (SUP) transportation apparatus to facilitate transportation of a SUP to and from a shoreline comprises a sled material and an adjustable attachment mechanism to temporarily attach the sled material to the SUP. The sled material has a top surface for supporting the SUP and a bottom surface for dragging over a ground surface, a longitudinal axis passing between a front end and a back end, and a latitudinal axis passing between a left side and a right side, wherein the longitudinal axis spans at least a portion of a length of the SUP and the latitudinal axis spans at least a width of the portion of the length of the SUP being supported. The adjustable attachment mechanism is able to join together to adjustably secure the sled material to the SUP and able to detach to release the sled material from the SUP.

18 Claims, 8 Drawing Sheets

(56) References Cited

U.S. PATENT DOCUMENTS

| | | | | |
|---|---|---|---|---|
| 7,810,820 | B2 * | 10/2010 | Wolf | A61G 1/01 280/18 |
| 9,226,564 | B1 * | 1/2016 | Cross | B63B 32/87 |
| 2006/0090824 | A1 * | 5/2006 | Kreft | A47J 37/0786 150/154 |
| 2008/0057805 | A1 * | 3/2008 | Alexander | B63B 32/87 441/75 |
| 2012/0006454 | A1 * | 1/2012 | Jenkins | B63B 32/70 150/154 |
| 2012/0118766 | A1 * | 5/2012 | Baker | B65D 81/03 220/660 |
| 2015/0122677 | A1 * | 5/2015 | Norrie | B63B 32/80 206/315.1 |
| 2020/0187610 | A1 * | 6/2020 | Bladd-Symms | B32B 3/26 |
| 2020/0229996 | A1 * | 7/2020 | Steinbock | A61G 1/013 |
| 2023/0183009 | A1 * | 6/2023 | Battershell | B65G 7/12 414/787 |
| 2023/0234679 | A1 * | 7/2023 | Flynn | B63B 32/87 206/315.1 |
| 2024/0131414 | A1 * | 4/2024 | Flynn | A63C 11/023 |

* cited by examiner

STAND UP PADDLE BOARD SLED

RELATED APPLICATIONS

This application claims the benefit of, and priority to, U.S. Provisional Patent Application No. 63/330,719, entitled "STAND UP PADDLE BOARD SLED", filed Apr. 13, 2022, which is hereby incorporated by reference in its entirety for all purposes.

TECHNICAL BACKGROUND

There is a continued and increased interest in the sport of stand up paddle boarding with people of all ages. However, there is some difficulty for people to carry or transport their paddleboard to the shore and back. Existing solutions are heavy and use bulky wheels to roll the paddleboard to the launch site, which creates a problem of having to return to your vehicle to securely store the transport apparatus, or simply leaving it behind on the shore, which could result in damage or theft.

OVERVIEW

The techniques disclosed herein relate to a mode of transporting a stand up paddleboard (SUP) to and from the shore or water's edge where the SUP may be used, such as a pond, lake, river, creek, reservoir, ocean, seaside, bay, or any other body of water. In at least one embodiment, a stand up paddleboard (SUP) transportation apparatus, also referred to herein as a SUP sled, may be employed to attach to the SUP for dragging the SUP to and from the shoreline and protecting the bottom of the SUP from damage that would otherwise be caused to the SUP by rubbing against the ground. In some embodiments, the SUP sled could comprise a universal, aftermarket product that attaches to a variety of different SUPs, and could be produced in several different sizes to accommodate different sized SUPs, such as small, medium, and large. In at least one embodiment, the SUP sled described herein could be provided with or "built-in" to a stand up paddleboard, thereby providing the transportation system along with the SUP in a single package. For example, in some embodiments, type of SUP and SUP sled combination could comprise a hardboard fiberglass stand-up paddle board with a SUP sled built-in and integrated into the bottom the SUP, or an inflatable SUP with a SUP sled attached as described herein. Note that although the present disclosure refers to a SUP sled and describes the use of the SUP sled on stand up paddleboards, the techniques described herein could apply equally to any other personal watercraft, such as kayaks, canoes, rafts, surfboards, hyrdrofoil boards or foilboards, and the like, possibly with slight modifications to accommodate differences in size and shape.

In one exemplary embodiment, a SUP sled could comprise a sled material and an attachment mechanism for attaching the sled material to a stand up paddleboard (SUP). In at least one embodiment, the sled material only covers a front or rear portion of the SUP, such as a nose or tail of the board, but the sled material could cover the entire bottom of the SUP in some implementations. The sled material could comprise any rugged material suitable for dragging over any type of terrain, including sand, dirt, gravel, grass, weeds, asphalt, cement, or any other kind of ground surface. In some examples, the sled material could comprise aluminum, heavy-duty plastic or any type of polymer such as polyethylene, foam board, Kevlar®/para-aramid fiber, military-grade Polyvinyl chloride (PVC) layer, closed-cell foam, lightweight foam core, or any other type of polymer that is durable and rugged for dragging along the ground, and possibly but not necessarily scratch resistant and/or pet friendly. In some implementations, the sled material could optionally protect the SUP sled from ultraviolet (UV) light exposure or sun damage and/or may have anti-aging properties. In at least one embodiment, the bottom side of the sled material could be a smooth, flat bottom, but the bottom of the sled material could also include raised portions and/or grooves in the material, such as tread lines, siping, fins, ridges, runners, or any other kind of tread pattern that may assist in cutting through the sand, dirt, or other type of terrain for ease of dragging.

The attachment mechanism could comprise any type of fastener, such as paracord or bungee/elastic netting, neoprene/polychloroprene or mesh-type sleeve, strong elastic shock cord, hook and loop fasteners or elastic straps, buckles, plastic or metal snaps or clips, carabiners, plastic clasp side release buckles, D-rings, cam buckles, tie-downs, ratcheting straps, cinching straps, loop straps, or any other type of securing mechanisms for attaching the sled material to the SUP, including combinations thereof.

In at least one implementation, a SUP transportation apparatus to facilitate transportation of a SUP to and from a shoreline comprises a sled material and an adjustable attachment mechanism to temporarily attach the sled material to the SUP. The sled material has a top surface for supporting the SUP and a bottom surface for dragging over a ground surface, a front end and a back end and a longitudinal axis passing between the front end and the back end, and a left side and a right side and a latitudinal axis passing between the left side and the right side, wherein the longitudinal axis passing between the front end and the back end spans at least a portion of a length of the SUP and the latitudinal axis passing between the left side and the right side spans at least a width of the portion of the length of the SUP being supported. The adjustable attachment mechanism has a left section and a right section, a first end of the left section of the adjustable attachment mechanism being permanently attached to the left side of the sled material and a first end of the right section of the adjustable attachment mechanism being permanently attached to the right side of the sled material, a second end of the left section of the adjustable attachment mechanism and a second end of the right section of the adjustable attachment mechanism able to join together to adjustably secure the sled material to the SUP and able to detach to release the sled material from the SUP.

In some implementations, the at least the portion of the length of the SUP over which the longitudinal axis passing between the front end and the back end of the sled material spans comprises a front nose portion of the SUP, such that the sled material is attached under the front nose portion of the SUP.

In some implementations, the sled material comprises a polymer, polyethylene, para-aramid fiber, or some other type of material.

In some implementations, the top surface of the sled material comprises a rough, skid-resistant texture.

In some implementations, the bottom surface of the sled material comprises a smooth, flat surface.

In some implementations, the bottom surface of the sled material comprises tread lines.

In some implementations, the sled material comprises a thickness of at least one sixteenth of one inch.

In some implementations, the sled material comprises a thickness of at least one eighth of one inch.

In some implementations, the sled material is able to roll up for storage.

In some implementations, the adjustable attachment mechanism comprises a strap, multiple straps, a ratcheting strap, a cam buckle, a plastic side release buckle, or any other type of fastening mechanism.

In some implementations, the second end of the left section of the adjustable attachment mechanism and the second end of the right section of the adjustable attachment mechanism are able to join together using a hook and loop fastener to adjustably secure the sled material to the SUP.

In some implementations, the first end of the left section of the adjustable attachment mechanism is permanently attached to a middle portion along the longitudinal axis on the left side of the sled material and the first end of the right section of the adjustable attachment mechanism is permanently attached to a corresponding middle portion along the longitudinal axis on the right side of the sled material.

In some implementations, the adjustable attachment mechanism has a second left section and a second right section, a first end of the second left section of the adjustable attachment mechanism being permanently attached to the left side of the sled material and a first end of the second right section of the adjustable attachment mechanism being permanently attached to the right side of the sled material, a second end of the second left section of the adjustable attachment mechanism and a second end of the second right section of the adjustable attachment mechanism able to join together to adjustably secure the sled material to the SUP and able to detach to release the sled material from the SUP.

In some implementations, the first end of the left section of the adjustable attachment mechanism is permanently attached to a front portion along the longitudinal axis on the left side of the sled material and the first end of the right section of the adjustable attachment mechanism is permanently attached to a corresponding front portion along the longitudinal axis on the right side of the sled material, and the first end of the second left section of the adjustable attachment mechanism is permanently attached to a rear portion along the longitudinal axis on the left side of the sled material and the first end of the second right section of the adjustable attachment mechanism is permanently attached to a corresponding rear portion along the longitudinal axis on the right side of the sled material.

This Overview is provided to introduce a selection of concepts in a simplified form that are further described below in the Detailed Description. It may be understood that this Overview is not intended to identify key features or essential features of the claimed subject matter, nor is it intended to be used to limit the scope of the claimed subject matter.

DETAILED DESCRIPTION

The following description and associated figures teach the best mode of the invention. For the purpose of teaching inventive principles, some conventional aspects of the best mode may be simplified or omitted. The following claims specify the scope of the invention. Note that some aspects of the best mode may not fall within the scope of the invention as specified by the claims. Thus, those skilled in the art will appreciate variations from the best mode that fall within the scope of the invention. Those skilled in the art will appreciate that the features described below can be combined in various ways to form multiple variations of the invention. As a result, the invention is not limited to the specific examples described below, but only by the claims and their equivalents.

Figure 1:
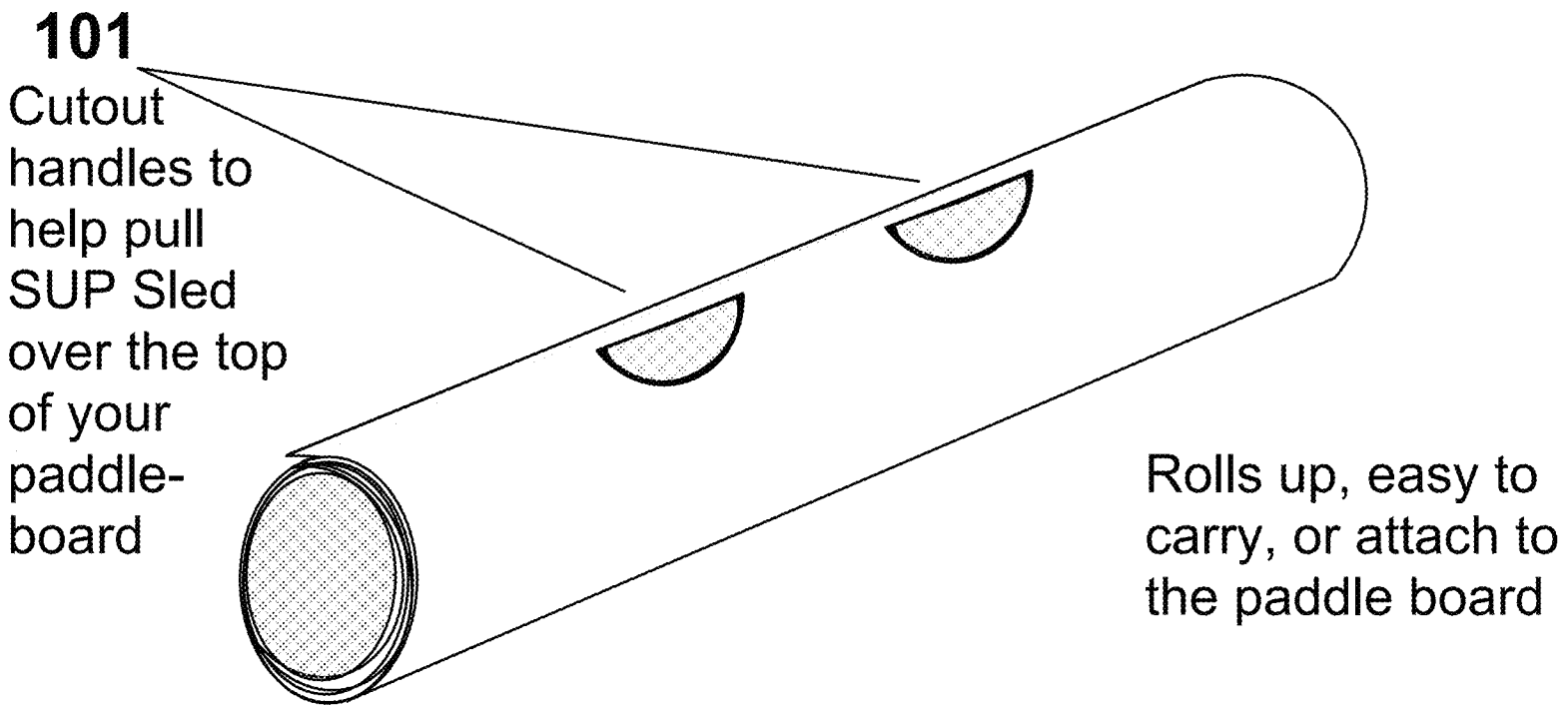
FIG. 1 illustrates a SUP sled rolled up for storage in an exemplary embodiment.

FIG. 1 illustrates a SUP sled rolled up for storage in an exemplary embodiment. The SUP sled shown in FIG. 1 rolls up easily to carry or attach to the paddleboard. For example, when rolled up as shown in FIG. 1, the SUP sled could be tied down or otherwise attached to a SUP while in use, or stored in a storage area of the SUP when paddling the SUP. The SUP board could be fitted with or include a quick-pull cord, elastic strap, hook and loop fasteners, clasp, or some other means of securing the SUP sled in a rolled-up fashion. In at least one embodiment, the SUP sled could comprise a material and construction that is rigid when straight but coils up when rolled, such as a slap bracelet. As also shown in FIG. 1, the SUP sled in this embodiment includes cut out handles 101 to help pull the SUP sled over the top of the paddleboard, and to hold on to when removing the SUP sled from the paddleboard.

Figure 2:
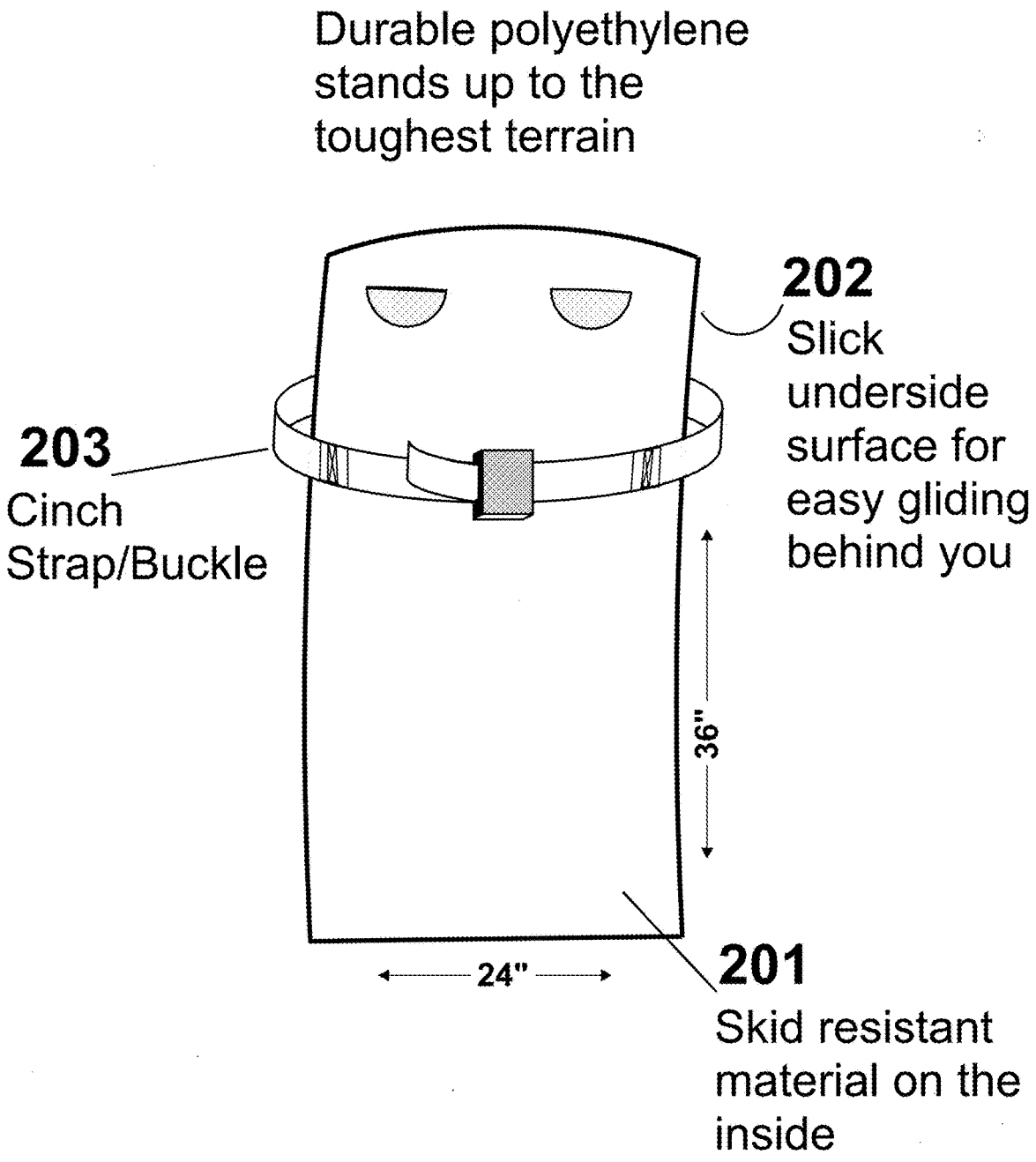
FIG. 2 illustrates a top view of a SUP sled rolled out in an exemplary embodiment.

FIG. 2 illustrates a top view of a SUP sled rolled out in an exemplary embodiment. As shown in FIG. 2, the top side 201 of the SUP sled in this embodiment is comprised of skid-resistant or abrasive textures or materials to prevent the SUP from sliding off of the sled and help hold the SUP onto the SUP sled, such as a rough or skid-resistant texture applied to the top side of the SUP sled material such as a lattice-shaped matrix, small cross-hatching, knurling, or grid pattern. Other examples of skid-resistant or abrasive textures or materials that could be applied to the SUP sled top surface 201 may include sand or grit textures, sticky rubber, nylon or neoprene/polychloroprene fabric, grip tape, or other textures or materials that provide friction and grip. In this embodiment, the bottom underside surface 202 of the SUP sled comprises a slick underside surface for easily gliding behind the user over any type of terrain, but other types of bottom surface 202 patterns or textures are possible. The SUP sled as shown in FIG. 2 includes a cinch strap or buckle that functions as an attachment mechanism 203 for securely attaching the SUP sled to a SUP, but any other type of attachment mechanism 203 is possible in other embodiments. In this embodiment, the SUP sled is comprised of durable polyethylene that stands up over time to the toughest terrain. In this embodiment, the width is 24 inches and the length is 36 inches to cover either the nose or tail of a SUP, but note that the width and length could be shorter or longer depending on the size of the paddleboard that the SUP sled is attached to and/or the amount of coverage desired. In some embodiments, the width and/or length could also be shorter or longer for different product offerings such as small, medium, and large SUP sleds. In at least one implementation, the length of the SUP sled is at least 5 inches long and the width of the SUP sled is at least the same width as the widest portion of the first five inches of the front nose portion of the SUP that the SUP sled is supporting. For example, if the width of the nose portion of the SUP that the SUP sled is supporting is twenty inches wide, then the width of the SUP sled should be at least twenty inches wide as well in order to provide adequate protection to the SUP while being dragged on the SUP sled. In some implementations, the thickness of the SUP sled could comprise any thickness that provides the durability and protection to the SUP as described herein, while also preferably still allowing the SUP sled to be rolled up for storage. For example, the thickness of the SUP sled could range from 1/32 inch to over one inch thick in some examples, but other thicknesses are possible and could vary with the type of material used in construction of the SUP sled. In some exemplary embodiments, the SUP sled could be 1/32 of an inch, 1/16 of an inch, 1/8 of an inch, 1/4 of an inch, or 1/2 of an inch thick, and could also vary in thickness over the length or width of the SUP sled in some embodiments, such as thinner near the edges and thicker in the middle.

Figure 3:
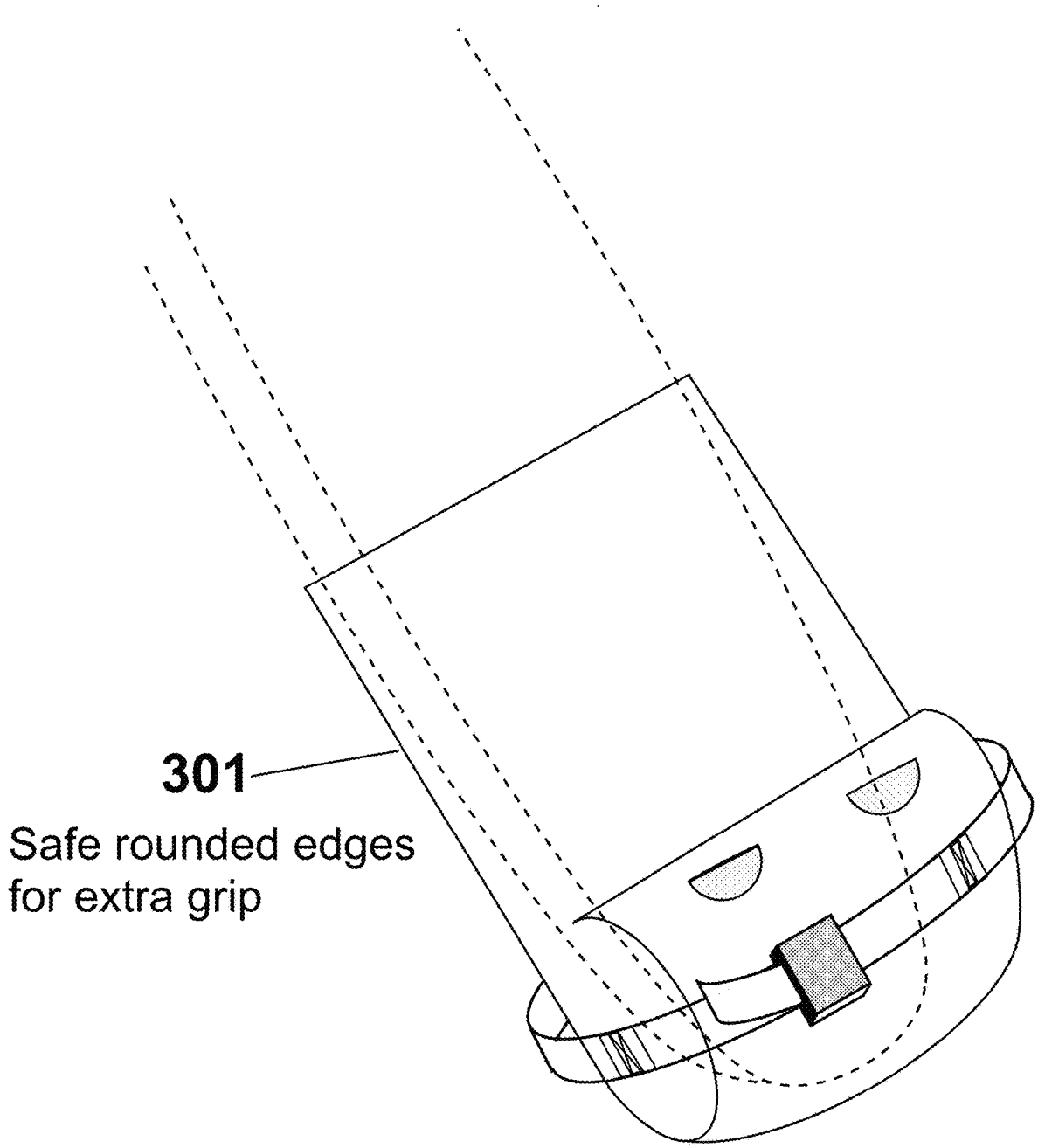
FIG. 3 illustrates a SUP sled attached to a paddleboard in an exemplary embodiment.

FIG. 3 illustrates a SUP sled attached to a paddleboard in an exemplary embodiment. In this embodiment, the SUP sled of FIG. 3 is shown attached to a SUP using a cinch strap or buckle, but any other attachment mechanism could also be used, such as paracord or bungee/elastic netting, neoprene/polychloroprene or mesh-type sleeve, strong elastic shock cord, hook and loop fasteners, elastic straps, buckles, plastic or metal snaps or clips, carabiners, plastic clasp side release buckles, D-rings, cam buckles, tie-downs, ratcheting straps, cinching straps, loop straps, or any other type of securing mechanism for fastening the sled material to the SUP, including combinations thereof. Also, as shown in FIG. 3, the SUP sled in this embodiment has rounded or smooth, raised edges 301 for added safety and to provide extra grip.

Figure 4:
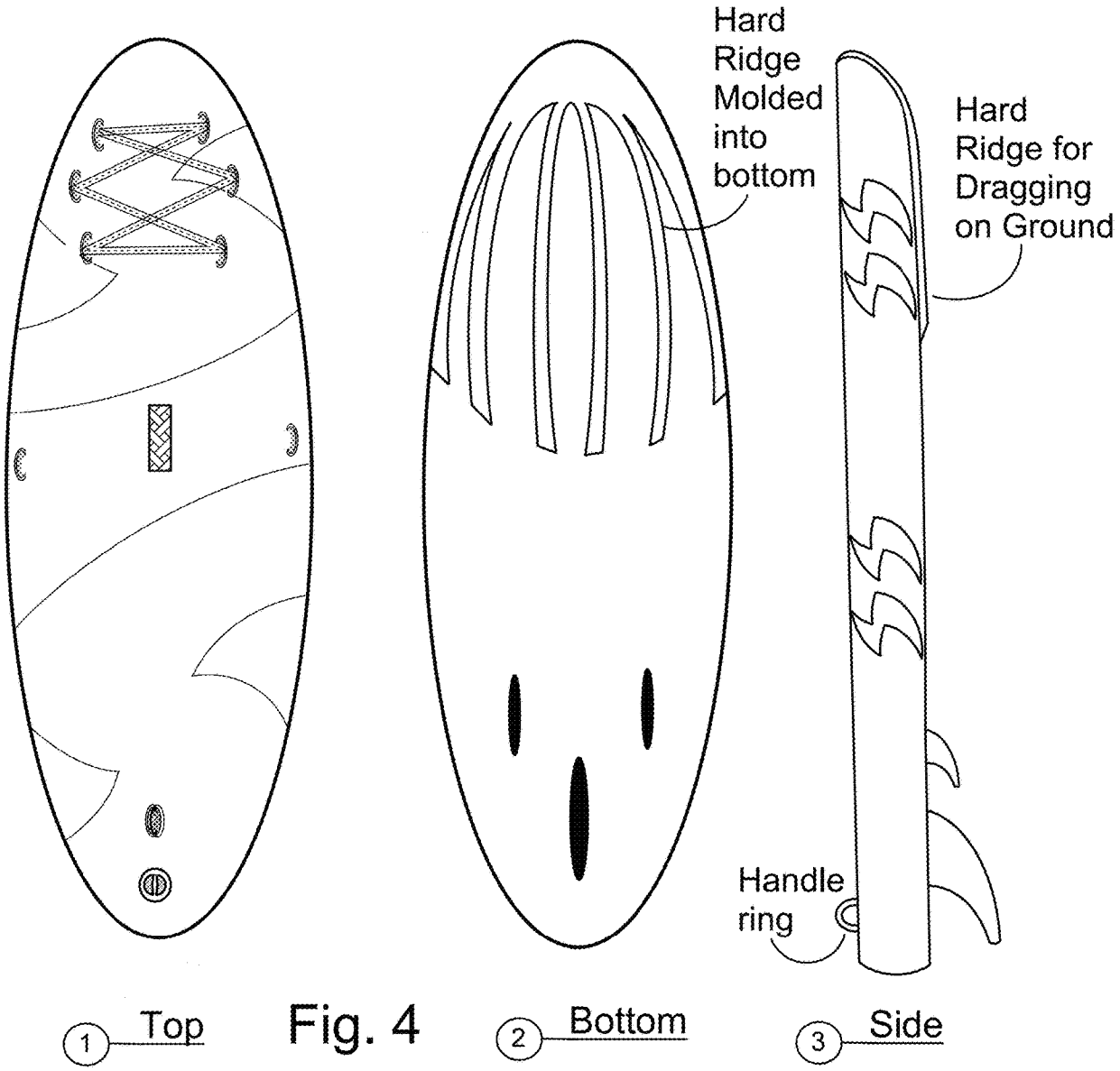
FIG. 4 illustrates a stand up paddleboard with built-in SUP sled in an exemplary embodiment.

FIG. 4 illustrates a stand up paddleboard with built-in SUP sled in an exemplary embodiment. As shown in FIG. 4, the top view shows a typical SUP because the sled is integrated onto the bottom of the SUP. The bottom view shows hard ridges molded into the bottom the SUP, but note that these ridges could also be other types of raised portions and/or grooves in the bottom material, such as tread lines, siping, fins, runners, or any other type of tread pattern that may assist in cutting through the sand, dirt, or other type of terrain for ease of dragging. Further, the ridges shown in the bottom view of FIG. 4 could be eliminated in some embodiments, providing a smooth surface for gliding along the ground. The bottom of the SUP with integrated SUP sled could be made of any type of rugged material suitable for dragging over any kind of terrain, including sand, dirt, gravel, grass, weeds, asphalt, cement, or any other type of ground. For example, the bottom of the SUP with integrated SUP sled, or at least the front nose portion of the bottom of the SUP, could comprise heavy-duty plastic or any type of polymer such as polyethylene, foam board, aluminum, Kevlar®/para-aramid fiber, military-grade Polyvinyl chloride (PVC) layer, closed-cell foam, lightweight foam core, or any other type of polymer that is durable and rugged for dragging along the ground, and possibly but not necessarily scratch resistant, and optionally providing UV/sun damage protection, made of pet-friendly materials, and having anti-aging properties.

The side view of the SUP with built-in SUP sled shows the side view of the hard ridge that is molded into the bottom of the SUP for dragging on the ground, along with a standard handle ring where an ankle strap is typically attached and could be used to drag the SUP, but note that any type of cord or strap could be attached to the handle ring for dragging the SUP. Also note that in the design shown in this embodiment, only the frontend nose portion of the SUP would be dragged along the ground, so that the fins at the rear of the SUP and not dragged along the ground and damaged during transport.

Figure 5:
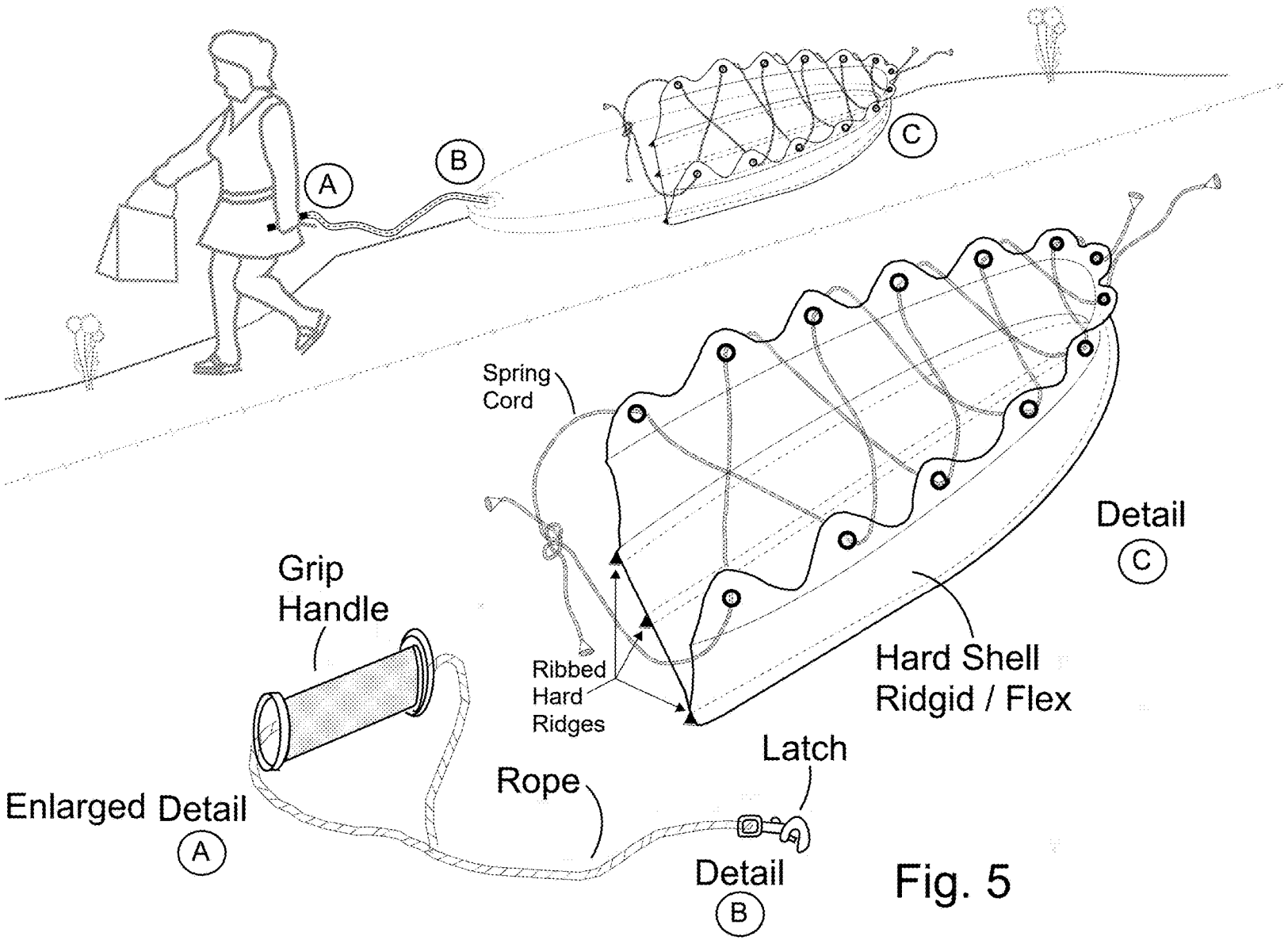
FIG. 5 illustrates an alternate implementation prototype of a SUP sled in an exemplary embodiment.

FIG. 5 illustrates an alternate implementation prototype of a SUP sled in an exemplary embodiment. In this embodiment, the SUP sled employs a spring cord with elasticity and a draw string fastener as an attachment mechanism to secure the SUP sled to a SUP. The SUP sled in this alternate implementation provides a hard, durable shell that includes hard, rigid ribs or ridges along the bottom but the shell itself is more flexible to allow for wrapping around the end of a SUP. Also shown in FIG. 5 is a easy grip drag cord that includes a comfortable grip handle on one end and a latch or clasp on the opposing end to attach to a handle ring, tie down, D-ring, or some other attachment loop on the SUP for dragging the SUP when attached to the SUP sled. The length of the drag cord could be any suitable length to lift the rear of the SUP off of the ground and allowing the frontend nose portion of the SUP that is covered by the SUP sled to be dragged over the ground.

Figure 6:
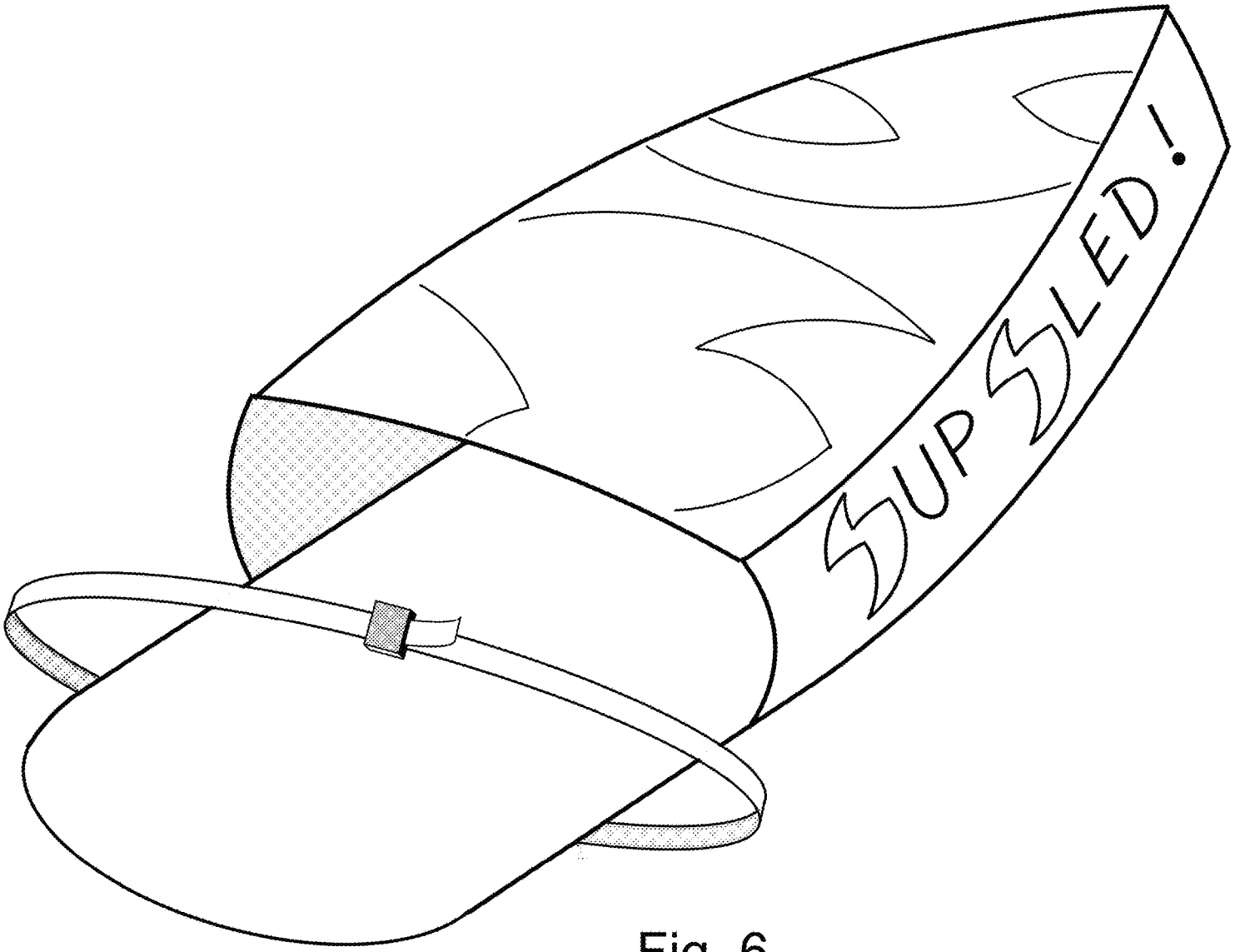
FIG. 6 illustrates an alternate implementation prototype of a SUP sled in an exemplary embodiment.

FIG. 6 illustrates an alternate implementation prototype of a SUP sled in an exemplary embodiment. The embodiment shown in FIG. 6 provides another possible implementation design for the SUP sled that could include a neoprene/polychloroprene sleeve upper portion with a reinforced, durable bottom. The SUP sled shown in FIG. 6 also includes a possible logo design applied to the SUP sled in an exemplary embodiment.

Figure 7:
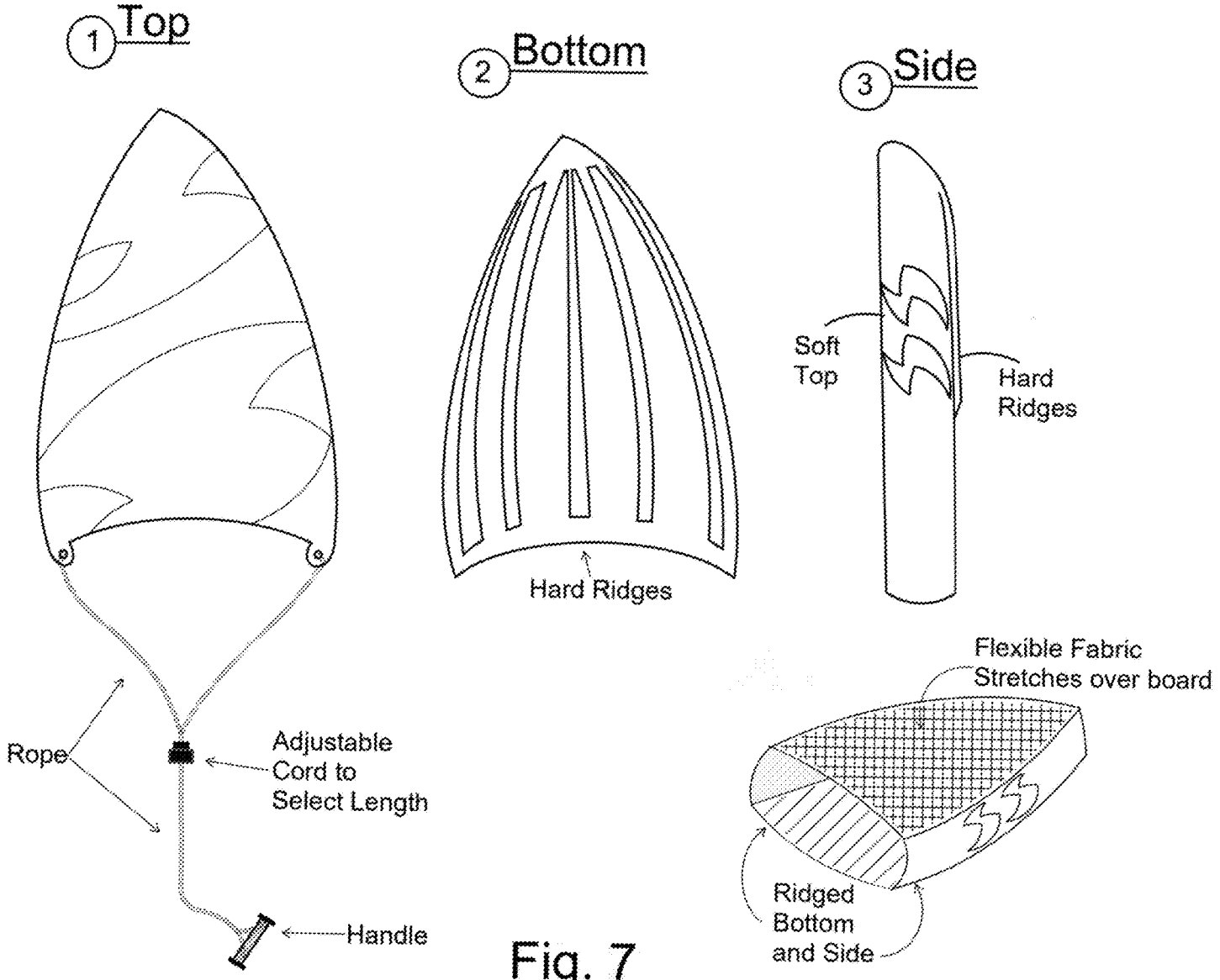
FIG. 7 illustrates a top, bottom, and side view of an alternate implementation prototype of a SUP sled in an exemplary embodiment.

FIG. 7 illustrates a top, bottom, and side view of an alternate implementation prototype of a SUP sled in an exemplary embodiment. The embodiment shown in FIG. 7 provides another possible implementation design for the SUP sled that could include a flexible fabric and/or fabric covered rubber or neoprene/polychloroprene upper portion that stretches over the paddleboard with a reinforced, durable rigid bottom. The top view shows that a grip cord or rope could be used with an adjustable cord to select the desire length of the pull cord to suit the user's preference, along with a handle attached to the end for pulling the board. The bottom view shows that the SUP sled may include hard ridges molded into the board to assist in dragging through the sand, dirt, or other terrain. The side view of the SUP sled in this embodiment shows the softer top material with the more durable and harder bottom material along with the hard ridges molded into the bottom of the SUP sled.

Figure 8:
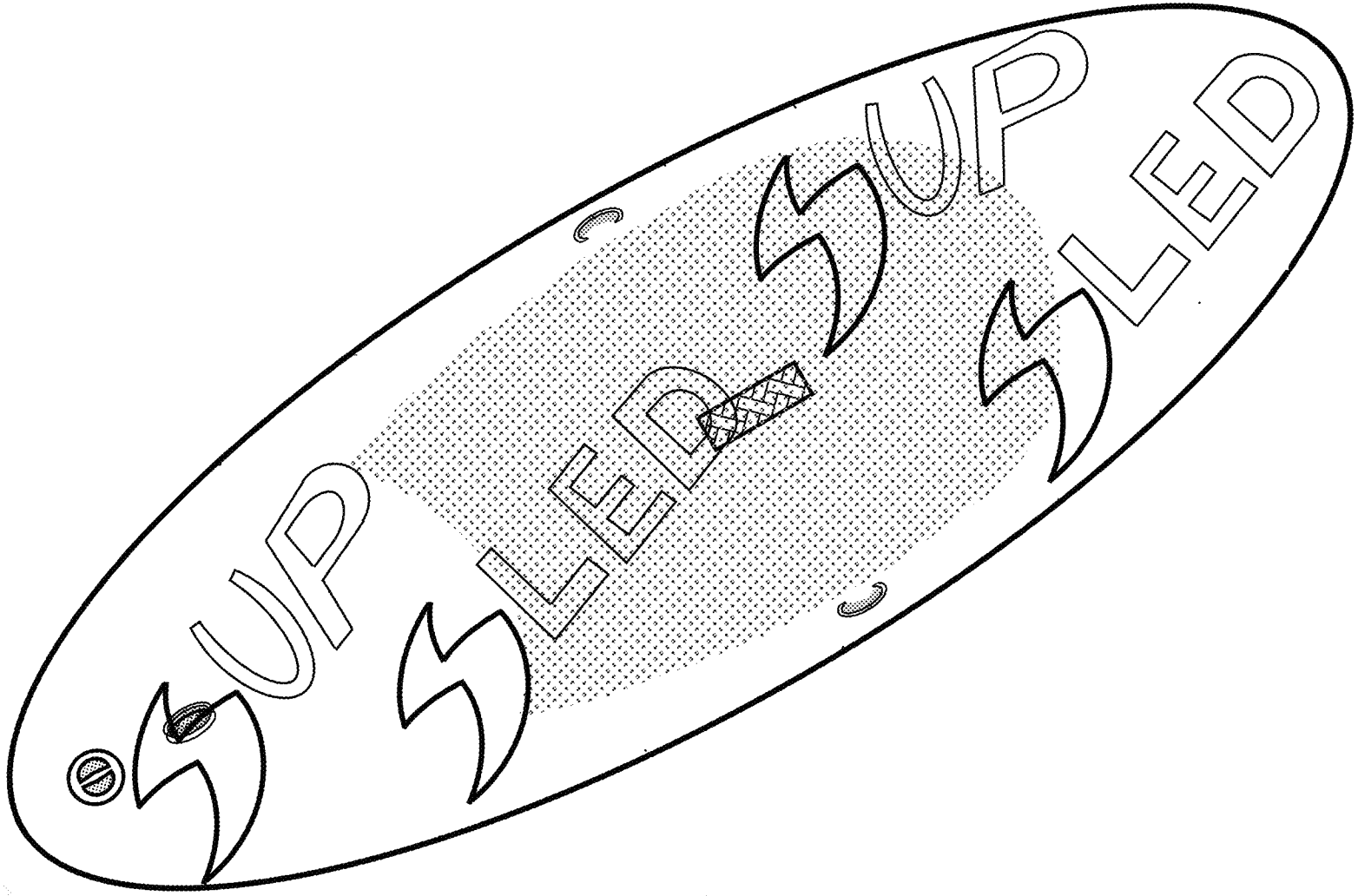
FIG. 8 illustrates a logo design applied to a SUP sled in an exemplary embodiment.

FIG. 8 illustrates a logo design applied to a SUP sled in an exemplary embodiment.

The above description and associated figures teach the best mode of the invention. The following claims specify the scope of the invention. Note that some aspects of the best mode may not fall within the scope of the invention as specified by the claims. Those skilled in the art will appreciate that the features described above can be combined in various ways to form multiple variations of the invention. As a result, the invention is not limited to the specific embodiments described above, but only by the following claims and their equivalents.

What is claimed is:

1. A stand up paddleboard (SUP) transportation apparatus to facilitate transportation of a SUP to and from a shoreline, the SUP transportation apparatus comprising:

the SUP;

a sled material having a top surface for supporting the SUP, wherein the top surface of the sled material comprises a rough, skid-resistant texture, and a bottom surface for dragging over a ground surface, wherein the bottom surface of the sled material comprises a smooth, flat surface, a front end and a back end and a longitudinal axis passing between the front end and the back end, and a left side and a right side and a latitudinal axis passing between the left side and the right side, wherein the longitudinal axis passing between the front end and the back end spans at least a front nose portion of the SUP and the sled material is adapted to cover the front nose portion of the SUP; and an adjustable attachment mechanism for temporarily attaching the sled material to the SUP, the adjustable attachment mechanism adapted to adjustably secure the sled material to the SUP and adjustably release the sled material from the SUP;

wherein the top surface of the sled material is attached under the front nose portion of the SUP by the adjustable attachment mechanism and the adjustable attachment mechanism is adapted to wrap around the front nose portion of the SUP in order to secure the sled material to the front nose portion of the SUP.

2. The SUP transportation apparatus of claim 1 wherein the latitudinal axis passing between the left side and the right side spans at least a width of the front nose portion of the SUP.

3. The SUP transportation apparatus of claim 1 wherein the sled material comprises a polymer.

4. The SUP transportation apparatus of claim 1 wherein the sled material comprises polyethylene.

5. The SUP transportation apparatus of claim 1 wherein the sled material comprises para-aramid fiber.

6. The SUP transportation apparatus of claim 1 wherein the bottom surface of the sled material comprises tread lines.

7. The SUP transportation apparatus of claim 1 wherein the sled material comprises a thickness of at least one sixteenth of one inch.

8. The SUP transportation apparatus of claim 1 wherein the sled material comprises a thickness of at least one eighth of one inch.

9. The SUP transportation apparatus of claim 1 wherein the sled material is able to roll up for storage.

10. The SUP transportation apparatus of claim 1 wherein the adjustable attachment mechanism comprises a flexible material adapted to wrap around the front nose portion of the SUP.

11. The SUP transportation apparatus of claim 10 wherein the flexible material stretches over the front nose portion of the SUP.

12. The SUP transportation apparatus of claim 10 wherein the flexible material comprises polychloroprene.

13. The SUP transportation apparatus of claim 10 wherein the flexible material comprises a flexible fabric.

14. The SUP transportation apparatus of claim 10 wherein the flexible material comprises rubber.

15. The SUP transportation apparatus of claim 1 wherein the adjustable attachment mechanism comprises a hook and loop fastener to adjustably secure the sled material to the SUP.

16. The SUP transportation apparatus of claim 1 wherein the adjustable attachment mechanism comprises a spring cord with elasticity and a draw string fastener to secure the sled material to the front nose portion of the SUP.

17. The SUP transportation apparatus of claim 1 further comprising a pull cord used to drag the bottom surface of the sled material over the ground surface.

18. The SUP transportation apparatus of claim 17 wherein the pull cord is adjustable to allow for selection of a desired length.

* * * * *